US006935066B2

(12) United States Patent
Davenport et al.

(10) Patent No.: US 6,935,066 B2
(45) Date of Patent: Aug. 30, 2005

(54) MOUNTING ASSEMBLY FOR A WEAPON ACCESSORY

(75) Inventors: Michael S. Davenport, Middleton, NH (US); Alan T. Howe, Merrimack, NH (US)

(73) Assignee: Insight Technology, Inc., Londonderry, NH (US)

( * ) Notice: Subject to any disclaimer, the term of this patent is extended or adjusted under 35 U.S.C. 154(b) by 0 days.

(21) Appl. No.: 10/799,330

(22) Filed: Mar. 12, 2004

(65) Prior Publication Data

US 2004/0244259 A1 Dec. 9, 2004

Related U.S. Application Data

(63) Continuation of application No. 10/279,753, filed on Oct. 24, 2002, now Pat. No. 6,705,038.

(60) Provisional application No. 60/336,412, filed on Oct. 24, 2001.

(51) Int. Cl.[7] ..... F41G 1/36

(52) U.S. Cl. ..... 42/114; 42/146; 42/148

(58) Field of Search ..... 42/114, 115, 116, 42/117, 132, 146, 124, 127, 128, 148

(56) References Cited

U.S. PATENT DOCUMENTS

| | | | | | |
|---|---|---|---|---|---|
| 5,033,219 | A | * | 7/1991 | Johnson et al. | 42/115 |
| 5,430,967 | A | * | 7/1995 | Woodman et al. | 42/114 |
| 5,787,630 | A | * | 8/1998 | Martel | 42/125 |
| 6,115,952 | A | * | 9/2000 | Rigler | 42/146 |
| 6,438,888 | B1 | * | 8/2002 | Lin et al. | 42/114 |

FOREIGN PATENT DOCUMENTS

DE 32 41 753 A1 * 5/1984

* cited by examiner

*Primary Examiner*—Stephen M. Johnson
(74) *Attorney, Agent, or Firm*—Grossman Tucker Perreault & Pfleger, PLLC

(57) ABSTRACT

A mounting assembly for mounting an accessory to a weapon frame having at least one slot formed in first and second sides thereof. The mounting assembly includes: a body; first and second jaws on opposing sides of the body, the first jaw having an engagement portion dimensioned to engage the first slot and the second jaw having an engagement portion dimensioned to engage the second slot; and a first biasing member configured to provide a biasing force against the first jaw to force the engagement portion of the first jaw into the first slot, and a second biasing member configured to provide a biasing force against the second jaw to force the engagement portion of the second jaw into the second slot. The mounting assembly may be easily and reliably attached to weapon without using tools.

3 Claims, 7 Drawing Sheets

MOUNTING ASSEMBLY FOR A WEAPON ACCESSORY

CROSS REFERENCE TO RELATED APPLICATIONS

This application is a continuation of U.S. patent application Ser. No. 10/279,753 filed Oct. 24, 2002, now U.S. Pat. No. 6,705,038, which claims benefit of U.S. Provisional Application No. 60/336,412 filed Oct. 24, 2001.

FIELD OF THE INVENTION

The invention relates generally to a mounting assembly and, more particularly, to a mounting assembly for attaching an accessory to a weapon.

BACKGROUND OF THE INVENTION

It is often desirable to mount an accessory, e.g. a scope, illuminator, laser aiming device, infrared aiming device, combined illuminator/aiming units, etc., to a weapon Conventionally, weapons have been configured with mounting rails, such as the GLOCK rail system, for directly receiving an accessory having features for mating with the rails. Although some weapon frames are available from a manufacturer with these mounting rails, many are not Attempts have been made, therefore, to provide a mounting assembly that adapts a rail system such as the GLOCK rail system to a given weapon frame shape and material. Conventional mounting assemblies use clamping mechanisms such as clips in the trigger guard and set screws to hold them in place on the weapon. These assemblies are typically composed of several parts and are difficult to install or remove. Moreover, the mounting assembly must be mounted to the weapon in a manner that maintains the accuracy of the mounted accessory while not marring the appearance and finish of the weapon, as well as not compromising the overall performance. Conventional assemblies do not reliably meet these requirements.

Accordingly, there is a need for a mounting assembly that may be easily and reliably mounted to a weapon to allow mounting of accessories while maintaining the appearance, finish, and performance of the weapon.

BRIEF SUMMARY OF THE INVENTION

A mounting assembly for mounting an accessory to a weapon frame having at least a first slot formed in a first side of the weapon frame and a second slot formed in a second side of the weapon frame, where the mounting assembly consistent with the invention includes: a body, first and second jaws on opposing sides of the body, the first jaw having an engagement portion dimensioned to engage the first slot and the second jaw having an engagement portion dimensioned to engage the second slot; and a first biasing member configured to provide a biasing force against the first jaw to force the engagement portion of the first jaw into the first slot, and a second biasing member configured to provide a biasing force against the second jaw to force the engagement portion of the second jaw into the second slot.

According to another aspect of the invention, there is provided a mounting assembly for mounting an accessory to a weapon frame having at least one slot formed in a side thereof, the mounting assembly consistent with the invention includes: a jaw including an engagement portion; a body having a pair of rails configured to accept the accessory, the body also having at least one opening configured to accept the engagement portion; and a biasing member having a first position and a second position, the biasing member in the first position providing a biasing force against the jaw to force the engagement portion through at least one opening in the body and into the slot to secure the mounting assembly to the weapon frame, the biasing member in the second position enabling the engagement portion to release from the slot to thereby release the mounting assembly from the weapon frame.

A method of securing a mounting assembly to a weapon frame consistent with the invention includes the steps of: positioning a jaw of the mounting assembly in juxtaposition with an associated slot in a side of the weapon frame; and positioning a biasing member in a first position, the biasing member in the first position configured to impart a biasing force against the jaw sufficient to force an engagement portion of the jaw into the associated slot to secure the mounting assembly to the apparatus.

BRIEF DESCRIPTION OF THE DRAWINGS

For a better understanding of the present invention, together with other objects, features and advantages, reference should be made to the following detailed description which should be read in conjunction with the following figures wherein like numerals represent like parts.

DETAILED DESCRIPTION

Figure 1:
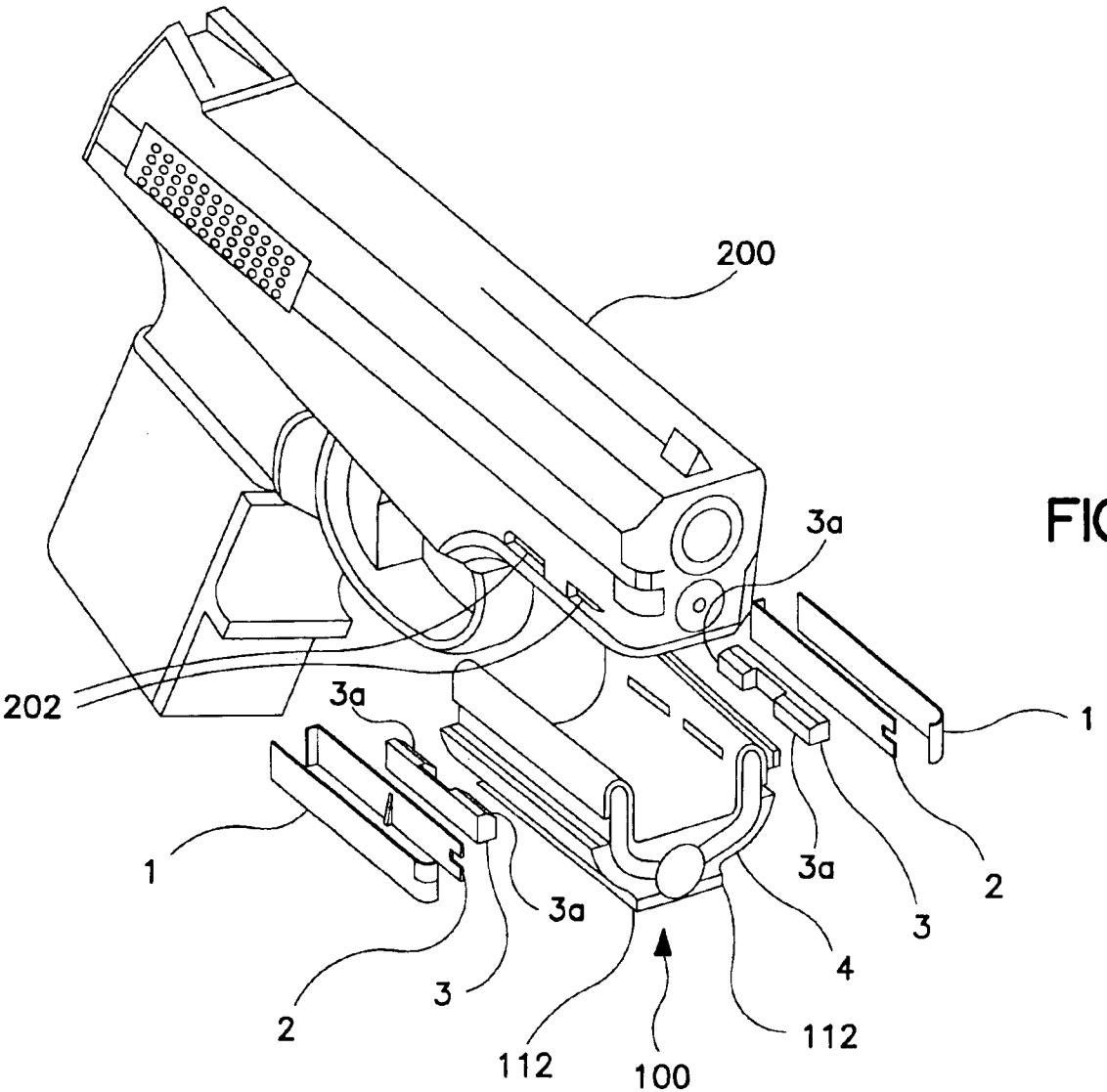
FIG. 1 is a perspective of an exemplary weapon with an exploded view of an exemplary mounting assembly consistent with the invention.
Figure 1B:
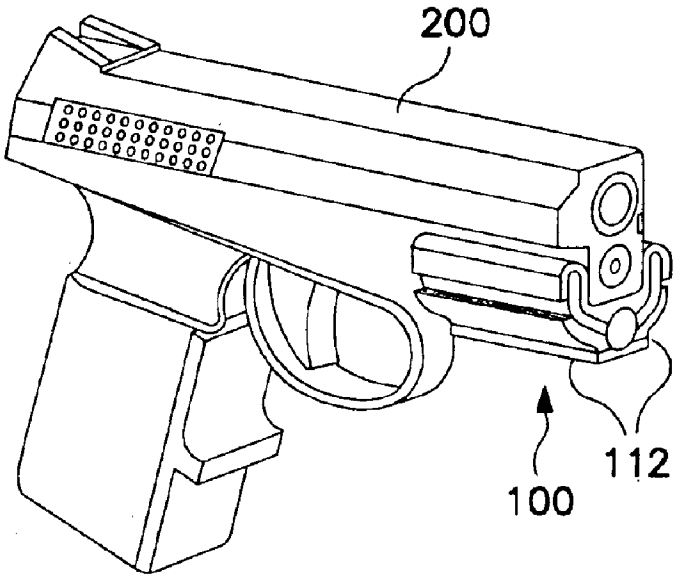
FIGS. 1A and 1B are perspective views of the exemplary mounting assembly of FIG. 1 mounted to the weapon illustrated in FIG. 1 in released and engaged positions, respectively.
Figure 1A:
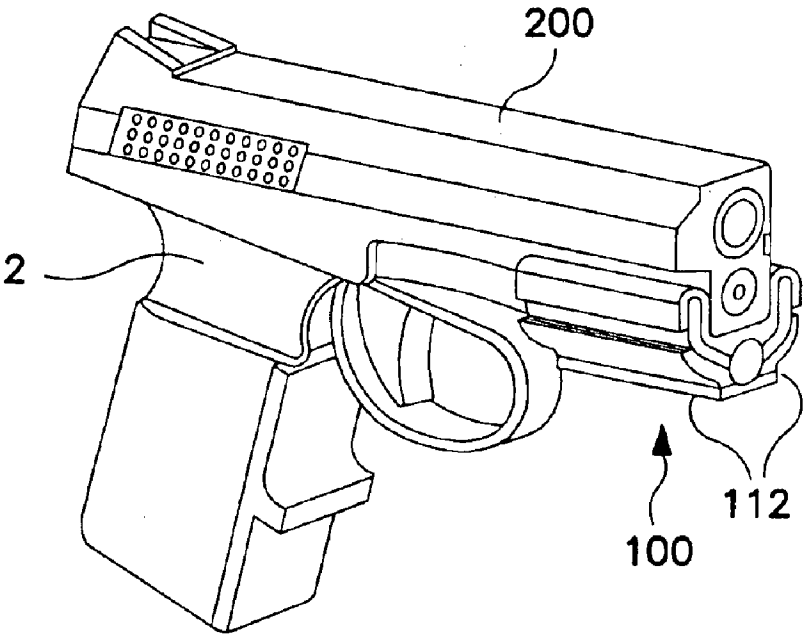

Referring now to FIGS. 1–7, there is illustrated an exemplary mounting assembly 100 consistent with the invention. In general, the assembly may be mounted to a weapon 200 to provide features, e.g. rails 112, for releasably attaching an accessory (not shown) to the weapon. The accessory to be mounted to the weapon via the mounting assembly 100 may be any number of auxiliary devices including, but not limited to, scopes, laser aiming devices, infrared aiming devices, illuminators, and aiming device/illuminator combinations. Additionally, it should be noted that the illustrated pistol-type weapon 200 is shown only by way of explanation. A mounting assembly consistent with the invention may be attached to other weapons including, but not limited to, shotguns and rifles. Moreover, the features described herein may be used to attach an auxiliary apparatus to other non-weapon frames including, but not limited to, helmets, bicycles, automobiles, and belts.

For convenience, the mounting assembly 100 is illustrated and described as providing rails 112, such as provided in the GLOCK rail system, for receiving corresponding rails on an accessory to be mounted to the weapon via the mounting assembly. In addition to the rails 112, the assembly may be provided with a position fixer receptacle (not shown) substantially normal to the pair of rails 112 to assist in fixing the position of the accessory to the weapon. An exemplary position fixer receptacle is illustrated in U.S. Pat. No. 6,185,854 assigned to the same assignee of this application, which is hereby incorporated by reference. The rails and position fixer receptacle should not be construed as a limitation of the invention. The novel features described herein may be incorporated into mounting devices for providing a variety of features for mating with an accessory.

In the illustrated exemplary embodiment, the mounting assembly 100 includes: slide covers 1, biasing members 2; jaws 3, and a body 4. Advantageously, no tools are required to mount or dismount the assembly from a weapon. Moreover, the mounting assembly 100 provides a firm mounting system while spring-loaded action gives it some flexibility so, for example, it will not cause a plastic frame to crush or collapse causing potential misfiring of the weapon.

Figure 2:
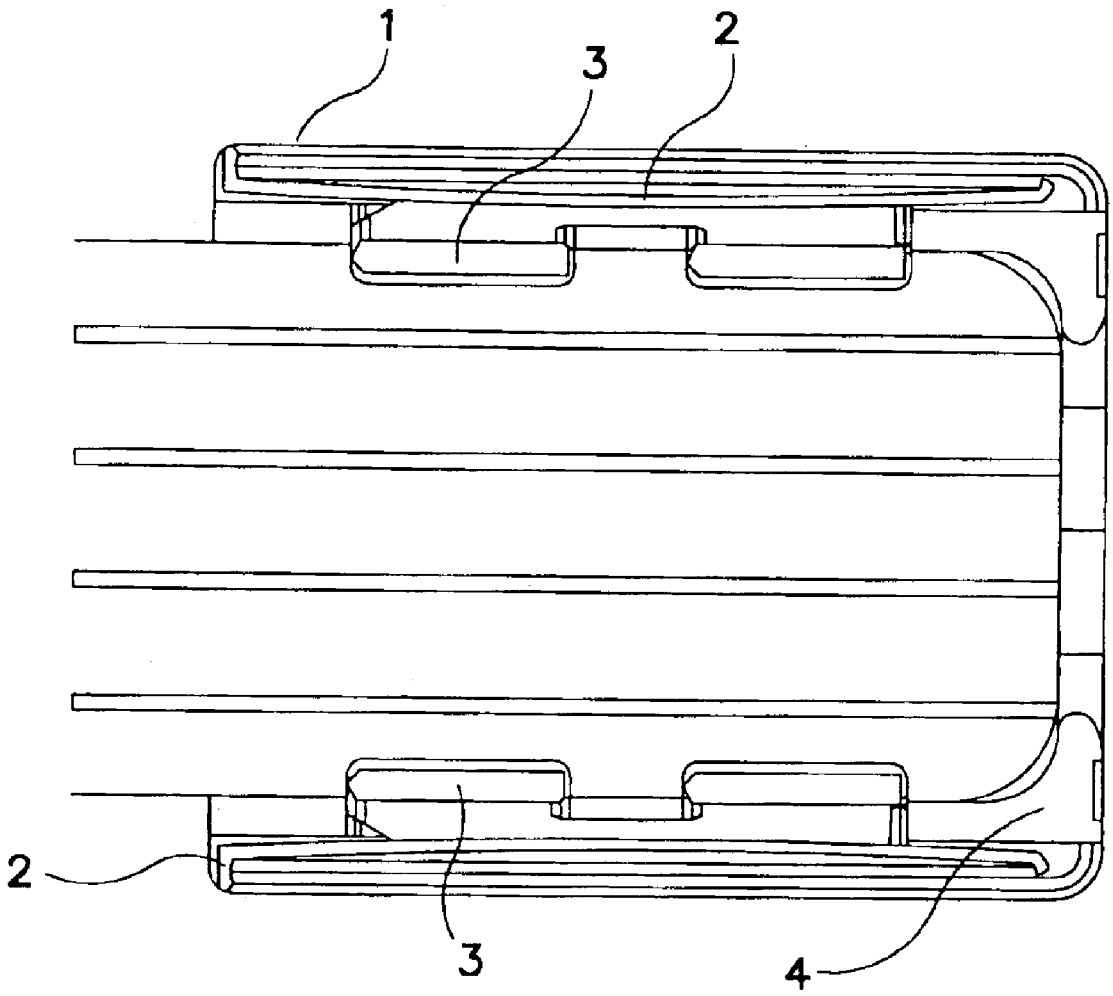
FIG. 2 is a partial sectional view of the mounting assembly of FIG. 1 in a closed and mounted position, as shown in FIG. 1B.
Figure 3:
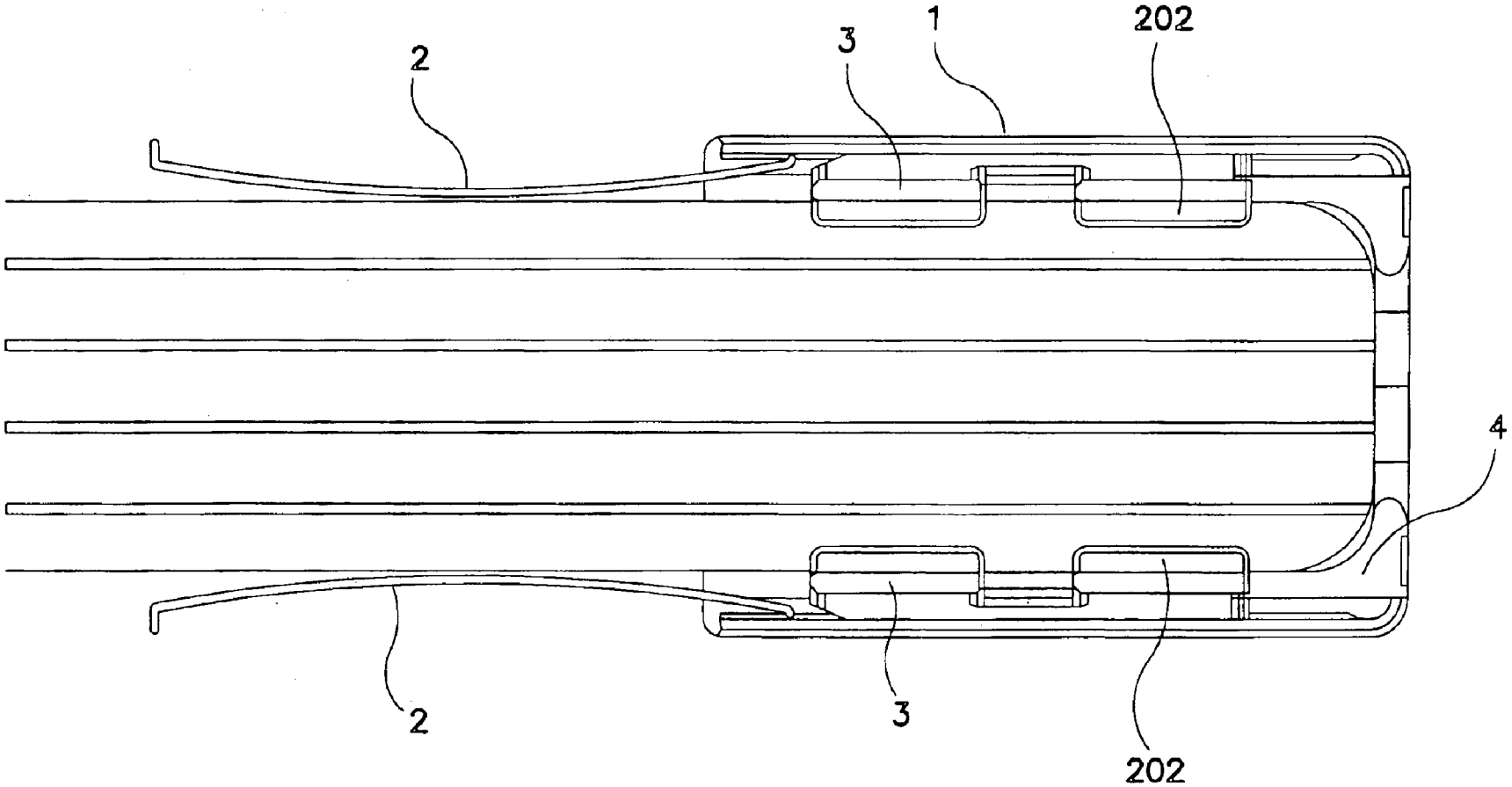
FIG. 3 is a partial sectional view of the mounting assembly of FIG. 1 in a released and open position, as shown in FIG. 1A.
Figure 4A:
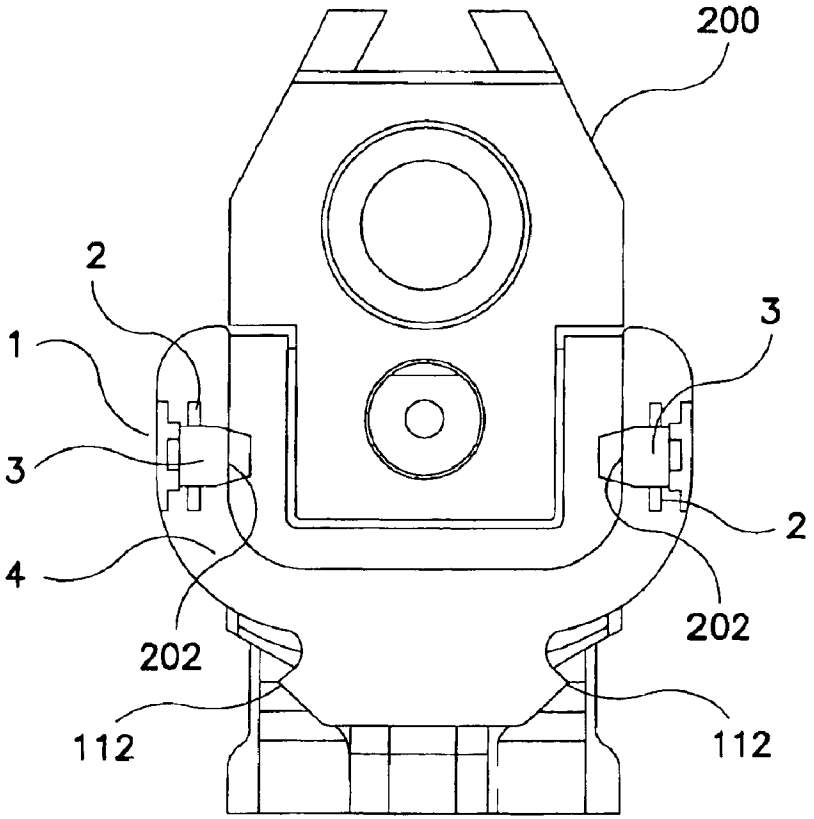
FIGS. 4A and 4B are end sectional views taken of the mounting assembly in open and closed positions as shown in FIGS. 1A and 1B, respectively.
Figure 4B:
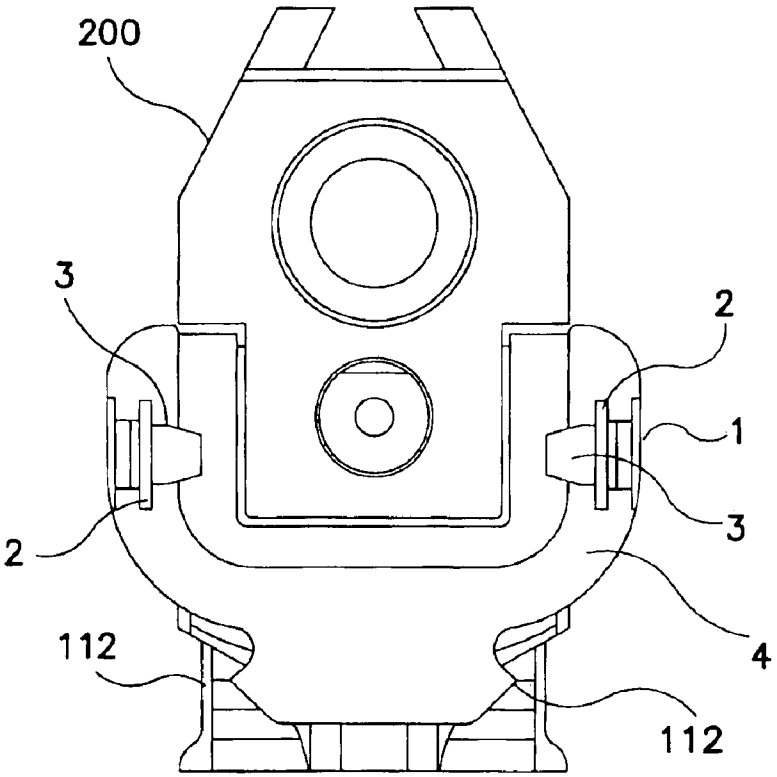
Figure 5:
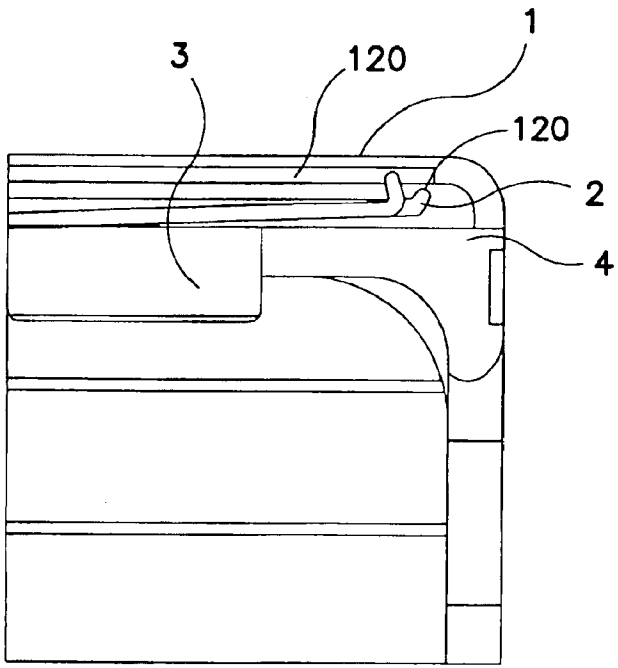
FIG. 5 is a partial sectional view of a mounting assembly consistent with the invention in a closed and engaged position.
Figure 7:
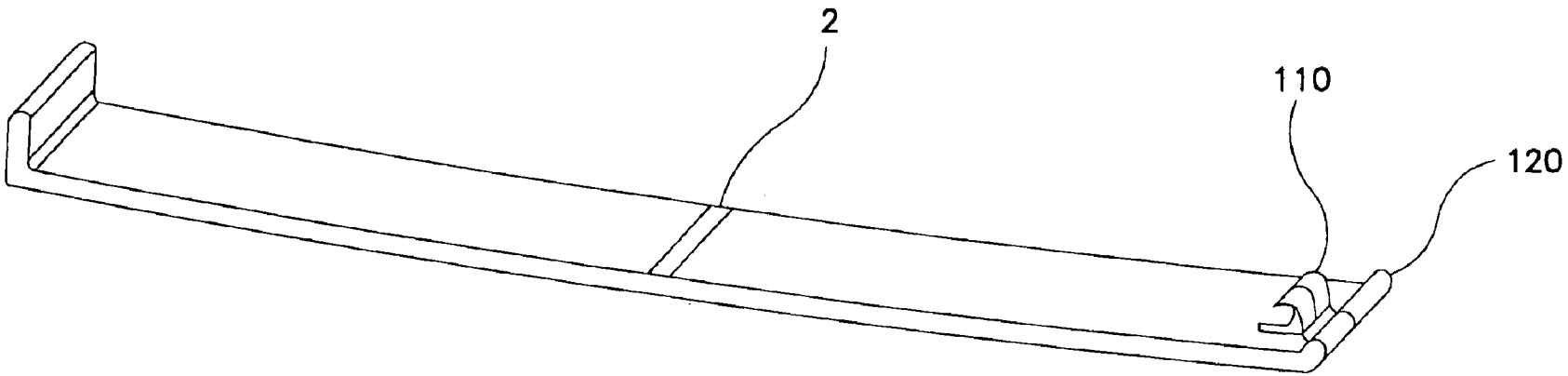
FIG. 7 is a perspective view of an exemplary spring portion for a mounting assembly consistent with the invention.

The device is mounted to the weapon frame by placing it into position, as shown in FIGS. 1A, 3, 4A and 6, with the jaws 3 having engagement portions 3*a* in juxtaposition with associated slots 202 in the sides of the weapon frame. The engagement portions 3*a* of the slot are dimensioned to engage the slots 202. The biasing members 2, e.g., springs in one embodiment as further described herein, are then moved forward until they lock into place, as shown in FIGS. 1B, 2, 4B and 5. Locking is caused by an angled protrusion 120 at the end of the spring opposite the handle (FIG. 7) falling over a 45 degree notch cut into the end of the "T" slot 120 in the body (FIG. 5). The springs, which are contained in the "T" slots on the sides of the body, are forced to flex against the back surface of the jaws 3 forcing the jaws into the slots 202 (FIG. 2). The jaws 3 are angled in such a way that they force the mount 100 to "pull up" tightly against the weapon frame (FIG. 4). This action forces the weapon frame to fit tightly within the mount body enabling the weapon aiming accessory to maintain its accuracy.

Figure 6:
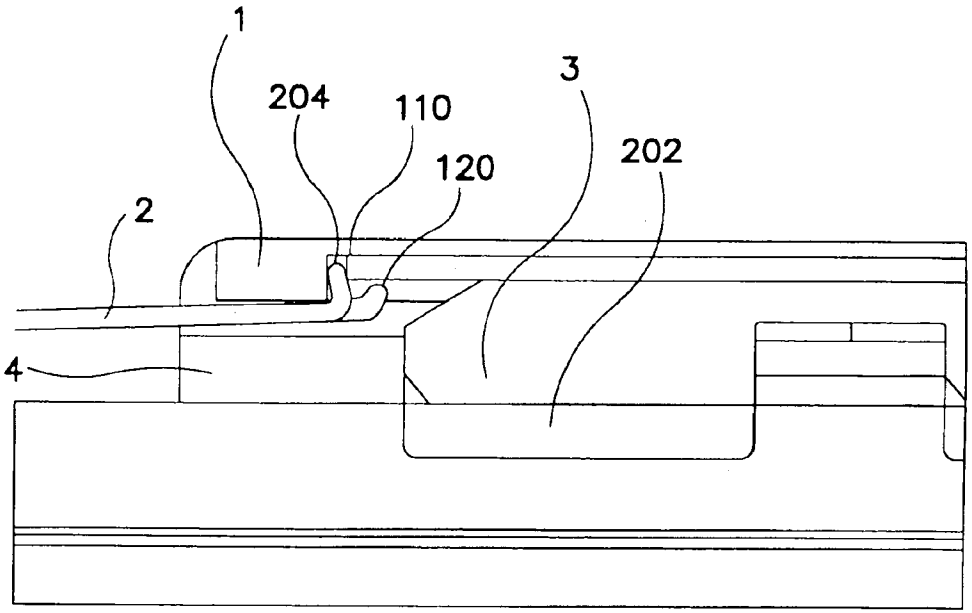
FIG. 6 is a partial sectional view of a mounting assembly consistent with the invention in an open and released position.

To remove the device, the springs 2 are simply retracted to the open position. The springs are restricted from traveling out of the body by engagement of the "finger" 110 (FIG. 7) on the end of the spring with a tab 204 on the inside of the side cover (FIG. 6). Retracting the springs 2 releases the pressure on the jaws 3 to allow the engagement portions of the jaws to back out of the slots 202 in the weapon frame with a twist of the body (FIG. 3).

Advantageously, the entire assembly 100 is self-contained as the side covers 1 keep the jaws 3 from coming out of the unit. The jaws retract enough to clear the inside of the body so the mount can be pulled off of the weapon frame smoothly. The springs are contained within the "T slots" of the main body and will only retract until the spring is stopped by the action of the fingers on the spring contacting a tab on the inside of the side cover, limiting the springs retraction travel short of the springs coming out of the main body. The leading ends of the springs are formed with an angle. This will prevent any stopping or binding effect when the jaws, which may be beveled on the ends, come into contact with the initial pushing in of the springs providing a smooth transition when the springs are engaged to lock the mount into position. The jaws will then move in an inward direction to engage the weapon frame causing the mount to lock into its fully engaged position.

Advantageously, a mounting assembly consistent with the invention provides a user-friendly and fully inclusive system that works on a spring-loaded jaw mechanism to ensure accuracy and functionality while maintaining the weapon's original condition. It can be installed or removed in seconds, has no loose parts to be misplaced, and no tools are required for installation or removal.

In each of the embodiments described above, the dimensions of the assembly may be such that the width of the assembly is minimized. Referring to FIGS. 4A and 4B, for example, it is preferable that the width of housing 4, at its widest point, does not substantially exceed the width of frame of weapon 200 measured at its widest point. When the assembly is attached to a frame having a front end, e.g. the frame of the pistol type weapon a depicted in FIG. 1, the dimensions may be such that protrusion of the device beyond the front end of the frame is minimized. Although several preferred embodiments of the present invention have been described in detail herein, the invention is not limited hereto. It will be appreciated by those having ordinary skill in the art that various modifications can be made without materially departing from the novel and advantageous teachings of the invention. Accordingly, the embodiments disclosed herein are by way of example. It is to be understood that the scope of the invention is not to be limited thereby.

What is claimed is:

1. A mounting assembly for mounting an accessory to a weapon frame having at least a first slot formed in a first side of said weapon frame and a second slot formed in a second side of said weapon frame, said mounting assembly comprising:

a body;

a first jaw adjacent a first side of said body and a second jaws adjacent a second side of said body, said first jaw having an engagement portion dimensioned to engage said first slot and said second jaw having an engagement portion dimensioned to engage said second slot; and a first spring, said first spring being adjacent said first side of said body with said first jaw disposed between said first slot and said first spring, said first spring being configured to provide a biasing force to force said engagement portion of said first jaw into said first slot, and a second spring said second spring being adjacent said second side of said body with said second jaw disposed between said second slot and said second spring, said second spring being configured to provide a biasing force to force said engagement portion of said second jaw into said second slot.

2. The mounting assembly of claim 1, wherein each said spring is at least partially disposed in said body and has a finger configured to contact an associated portion of said body to prevent said spring from traveling out of said body.

3. The mounting assembly of claim 1, wherein each said spring has an angled protrusion configured to contact an associated portion of said body to lock said spring in said body.

* * * * *

UNITED STATES PATENT AND TRADEMARK OFFICE

CERTIFICATE OF CORRECTION

PATENT NO. : 6,935,066 B2
APPLICATION NO. : 10/799330
DATED : August 30, 2005
INVENTOR(S) : Davenport et al.

It is certified that error appears in the above-identified patent and that said Letters Patent is hereby corrected as shown below:

Claim 1, column 4, line 40: "Jaws" delete and insert --Jaw--.

Signed and Sealed this

Twenty-fifth Day of July, 2006

JON W. DUDAS
*Director of the United States Patent and Trademark Office*